United States Patent [19]

Schimmel

[11] Patent Number: 4,612,857

[45] Date of Patent: Sep. 23, 1986

[54] BALLISTIC GAS FIRED DEVICE

[75] Inventor: Morry L. Schimmel, University City, Mo.

[73] Assignee: McDonnell Douglas Corporation, St. Louis, Mo.

[21] Appl. No.: 631,145

[22] Filed: Jul. 16, 1984

[51] Int. Cl.[4] ..... F42C 19/00; F42C 19/08

[52] U.S. Cl. ..... 102/204; 102/202; 102/275.2

[58] Field of Search ..... 102/275.2, 275.3, 275.4, 102/275.5, 275.7, 275.11, 275.12, 204, 202; 89/1.817, 1.14; 42/10

[56] References Cited

U.S. PATENT DOCUMENTS

| | | | |
|---|---|---|---|
| 2,823,609 | 2/1958 | Johnson et al. | 102/275.3 |
| 3,140,638 | 7/1964 | De Luca | 89/1.817 |
| 3,169,480 | 2/1965 | Seavey | 102/275.2 |
| 3,326,127 | 6/1967 | Schimmel | 102/275.2 |
| 3,610,151 | 10/1971 | Nett | 102/204 |
| 3,945,322 | 3/1976 | Carlson et al. | 102/275.4 |
| 3,982,488 | 9/1976 | Rakowsky et al. | 102/224 X |
| 3,985,058 | 10/1976 | Corrado et al. | 102/224 X |
| 4,378,739 | 4/1983 | Klein et al. | 102/204 |
| 4,423,682 | 1/1984 | Schimmel | 102/275.2 |
| 4,498,368 | 2/1985 | Doane | 89/1.817 |

*Primary Examiner*—David H. Brown

*Attorney, Agent, or Firm*—Gravely, Lieder & Woodruff

[57] ABSTRACT

A hot ballistic gas fired explosive transfer device embodying an explosive train sealed against environmental effects and placed in the line of delivery of hot ballistic gas which ruptures the seal and initiates the action of the explosive train. The explosive transfer device is arranged for applications with escape systems having shielded mild detonating cords, or having primers for activating rocket motors.

10 Claims, 6 Drawing Figures

FIG. 1
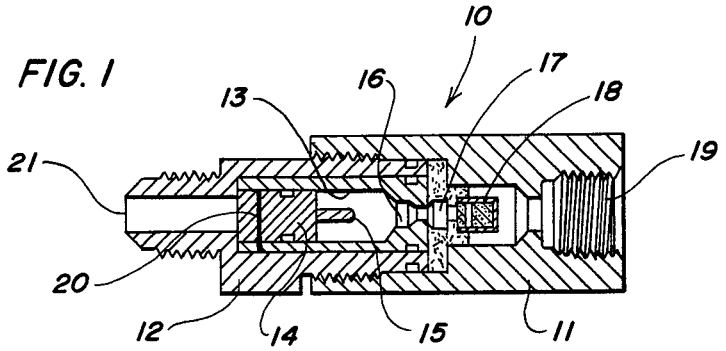
PRIOR ART
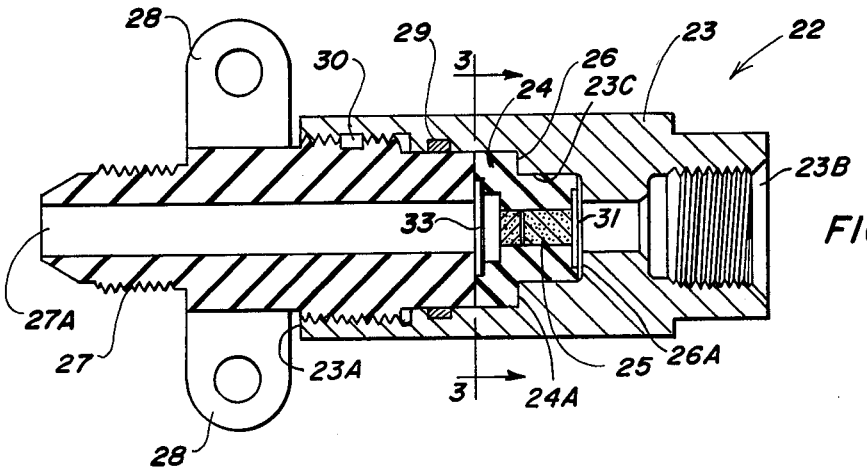
FIG. 2
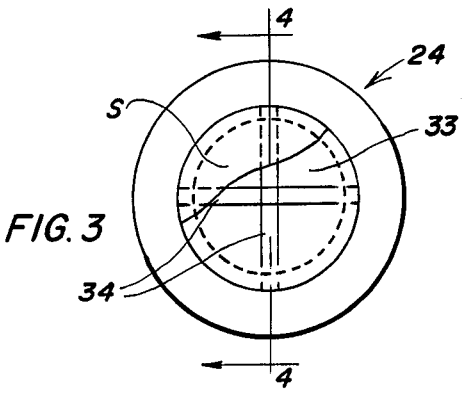
FIG. 3
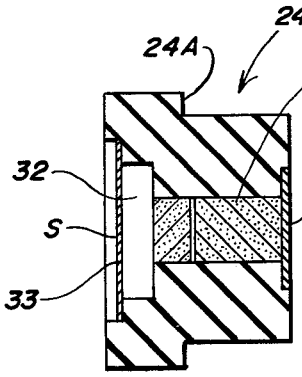
FIG. 4

FIG. 5
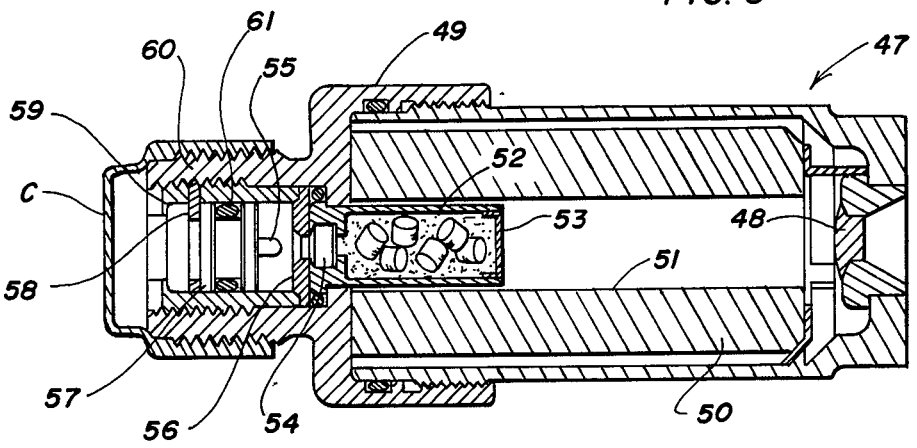
PRIOR ART
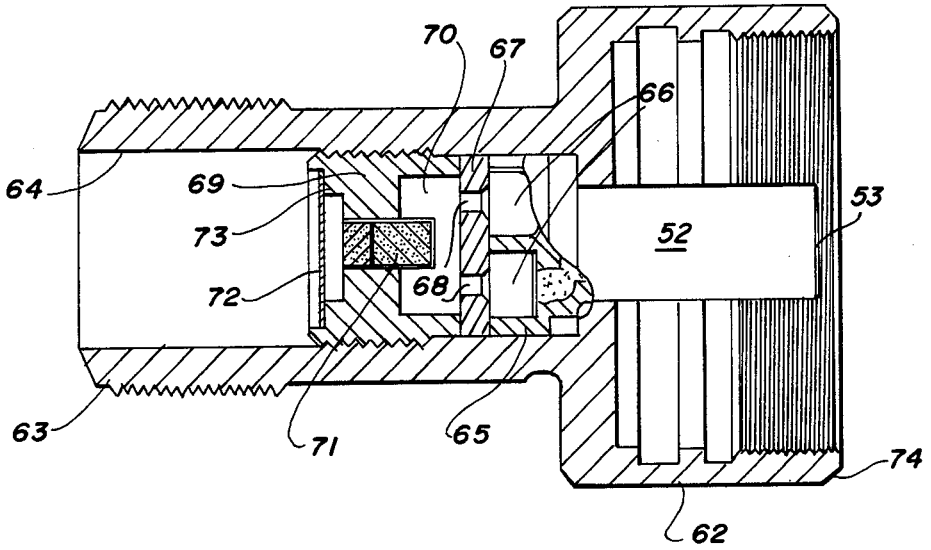
FIG. 6

BALLISTIC GAS FIRED DEVICE

BACKGROUND OF THE INVENTION

1. Field of the Invention

This invention relates to emergency escape systems utilizing a ballistic gas fired device wherein a hot ballistically generated gas is delivered from a remote source directly to an explosive energy transfer device incorporated in the escape system.

2. Description of the Prior Art

An explosive device utilized in escape systems and principally applicable to aircraft installations is represented in Schimmel U.S. Pat. No. 3,326,127 of June 20, 1967 in which the explosive devices are mounted in an angular relation so that the transfer of energy is affected in only one direction. A more recent disclosure is found in Klein et al U.S. Pat. No. 4,378,739 of Apr. 5, 1983 which is directed to a firing mechanism for detonating a plurality of percussion primers by delivering explosive energy through a shielded mild detonating cord. A still more recent disclosure is found in Schimmel U.S. Pat. No. 4,423,682 of Jan. 3, 1984 which relates to a one-way explosive transfer assembly wherein initiating energy is delivered by a sheilded mild detonating cord and is transferred in only one direction to an output shielded mild detonating cord.

The prior art is also exhibited by energy conversion devices in which ballistic gas input is directed against a piston element held in position by a shear pin which must be sheared off to release the piston carrying a firing pin for striking a primer which, in turn, transfers the energy to an output which may be either a rocket motor or a shielded mild detonating cord.

The problem with the prior art devices resides in the expense involved in making the several individual parts which go into a finished assembly and also in the possibility that the assembly of the parts could result in defective elements and especially the primer devices which are present. There is also the problem of obtaining reliability which is very important when devices of this type are incorporated in emergency aircraft escape systems.

BRIEF SUMMARY OF THE INVENTION

The present invention is directed to a ballistic gas fired device utilizing the heat and pressure of the ballistic gas for activating an explosive train device used in an emergency escape system. The objects of the present invention are to improve on the prior art devices by eliminating as many components and elements as possible so as to simplify the assembly, to reduce the cost of manufacture of such devices, and to gain greater assurance of reliable operation.

A preferred embodiment of the present invention is directed to a hot ballistic gas fired device in which improvements comprise the simple provision of a housing having inlet and outlet ends communicating with an internal cavity, mounting an explosive train in the housing cavity, sealing the explosive train against deteriorating from environmental influences and providing means for admitting hot ballistic gas directly against the explosive train for effecting or initiating the firing of that explosive train so as to initiate the escape system in which the device is incorporated.

The present invention will be set forth in connection with certain modifications to be disclosed and described in detail hereinafter.

BRIEF DESCRIPTION OF THE DRAWINGS

The present invention is best illustrated in the accompanying drawings, wherein:

FIG. 1 is a longitudinal sectional view of what is considered to be a conventional prior art firing pin explosive initiator utilizing ballistic gas input to drive the firing pin into an explosive primer which, in turn, sets off an explosive train;

FIG. 2 is a longitudinal sectional view of the assembly of a hot ballistic gas fired device setting forth the embodiment of the present invention;

FIG. 3 is a transfer section taken along line 3—3 in FIG. 2 showing the application of a seal coating over a component of that assembly;

FIG. 4 is a transfer section taken along line 4—4 of the component illustrated in FIG. 3;

FIG. 5 is a longitudinal sectional view of a further example of conventional prior art explosive initiator utilizing a firing pin and primer for activating a rocket motor; and FIG. 6 is a modification of the present invention adapted to incorporate ballistic gas initiation of primers for activating a rocket motor.

DETAILED DESCRIPTION OF THE EMBODIMENTS

In order to illustrate the advantages and improvements which the present invention embodies over the prior art, there is illustrated in FIG. 1 a current conventional device 10 having a main body 11 threadedly receiving ah insert 12 for the reception of an internal sleeve 13 which forms the cylinder for a piston 14 formed with a firing pin 15. The firing pin is aligned so as to enter a port 16 in the inner closed end of the cylindrical sleeve 13 so as to allow the firing pin 15 to pass through the port and impact a primer 17 for the purpose of activating an explosive train 18 which is intimately associated with the primer 17. The explosive train 18 delivers its energy through an outlet 19 which can be occupied by a shielded mild detonating cord of conventional character or a suitable rocket motor which, in some instances, is incorporated in an escape system. It is seen in FIG. 1 that the insert 12 locates the cylindrical sleeve 13 and all of the parts associated therewith, including a shear pin 20, whereby ballistic gas can be admitted through the inlet 21 to propel the piston 14 and drive its pin 15 into the primer 17 to initiate the intended operation of such a device.

FIG. 2 illustrates a presently preferred embodiment of the present invention which is shown in the assembly 22 as being made up of a housing 23 which has an inlet end 23A and an outlet end 23B, and is counterbored from the left hand end to provide a cavity 23C to receive a holder 24 for an explosive train 25. The holder 24 is firmly held in abutment by its external shoulder 24A in position against an internal shoulder 26 surrounding the cavity 23C by the threaded mounting of a hot gas delivery sleeve 27 in the housing 23. The sleeve may or may not incorporate mounting lugs 28, depending on the location and means for securing the assembly in operative position. The sleeve 27 is embraced by an O-ring seal 29 and may be locked into position by a key element 30. It is noted that the sleeve 27 is formed with a bore 27A which is adapted to direct hot ballistic gas from a remote source (not shown) directly against the assembly of means in the holder 24.

Turning now to FIGS. 3 and 4 it can be seen that the holder 24 is a suitable body for axially locating the explosive train 25 such that the output end of the explosive train is positioned against a metallic closure disc 31 which is circumferentially stitch welded or otherwise attached to the body of the holder 24. The opposite face of the holder 24 is formed with a counterbored cavity 32 which is adapted to be closed by a metallic disc 33 which, again, is stitch welded or otherwise secured in the face of the holder 24 so as to enclose the cavity 32. As seen in FIG. 3, the disc 33 is structurally weakened by the formation of scoring 34 which is a way of weakening the integrity of the disc without actually penetrating through to the cavity 32. In some instances, the scored surface of the disc 33 may be given a thin coating of a suitable sealant without detracting from the intended structural weakness of the disc. The sealant coating is shown fragmentarily at S in FIG. 3. It should be understood that when hot ballistic gas is delivered through the bore 27A of the sleeve 27, it is generated with a delivery pressure greater than 500 psi which is sufficient to rupture the disc 33 and deliver the hot gas directly at the explosive train 25. In the rupture of the disc 33 the material thereof is ruptured in the form of petals that bend or are driven into the cavity 32 which is provided for that purpose so that the hot gas is effectively delivered on the explosive train 25.

The makeup of the explosive train may be a combination of two or three components, but primarily lead azide and hexanitrostilbene. The third element is lead styphnate and may be utilized for accelerating the explosive action of the train. An important feature of the assembly shown in FIG. 4 is that the respective seals 31 and 33 are to enclose the explosive train and isolate it from environmental influences that might affect the intended response of the explosive train.

The embodiment of the present invention as illustrated in FIG. 2 can be seen to greatly simplify the construction of such a device over that shown in the prior art of FIG. 1. The simplification is directed to eliminating a number of unnecessary elements and making it possible to deliver hot ballistic gas directly onto an explosive train so as to greatly improve the reliability of initiating the operation of an escape system, and to accomplish this at reduced cost because of the elimination of a number of components that have heretofore been believed necessary. The simplification results in increased reliability.

Turning now to FIG. 5, a brief disclosure of a conventional prior art device is seen to include a rocket motor housing 47 with the usual nozzle blowout plug 48 therein, and a head cap 49 which is threadedly engaged on the housing 47 at the opposite end from the location of the blowout plug 48. The housing 47 contains a body of solid propellant fuel 50 with a hollow bore 51 which receives an igniter cartridge 52 inserted opposite the blowout plug 48. The cartridge 52 is provided with an end seal 53, while the opposite end is associated with the firing mechanism for activating a primer 54 which, in torn, activates the igniter cartridge 1552 when a firing pin 55 is forced to pass through a port in a firing pin stop 56. The firing pin 55 is carried by a piston 57 which is held by a shear pin 58 in a cylinder 59. The cylinder is threadedly mounted in the reduced end 60 of the head cap, and the piston is suitably sealed therein at 61. The reduced end 60 of the head cap is adapted to be connected to a hot ballistic gas source (not shown) which develops sufficient pressure on the piston 57 to shear the shear pin 58 and drive the firing pin 55 through the firing pin stop 56 so that it activates the primer 54 to set up the necessary chain reaction in the igniter cartridge 52. A protective removable cap C covers the end 60 until the assembly is installed.

The embodiment disclosed in FIG. 6 pertains to the improvements that are associated with a head cap 49 of the prior art example, but in the present embodiment an improved head cap 62 forms a housing which receives a number of simplified and less expensive components now to be described. The inlet end 63 of the head cap housing opens into an internal bore 64 for the reception of a carrier 65 for a pair of primers 66, and the carrier is positioned in the bore 64 by an orifice plate 67 which is provided with orifices 68 which are aligned respectively with the primers 66. The carrier and the orifice plate are secured in the bore 64 by a holder 69 which is threadedly mounted so that its inner end bears on the orifice plate 67 to provide a cavity 70 in front of the orifices. The holder 69 carries an explosive train assembly 71 and is enclosed in the holder by a suitable frangible seal disc 72 secured by circumferential stitch welding at 73. The outlet opening 74 for the head cap 62 housing is enlarged so as to be able to receive the cartridge 52 for a rocket motor housing such as the one shown at 47 at FIG. 5.

In comparing the embodiment of FIG. 2 with the embodiment of FIG. 6 it can be appreciated that the protective closure 72 is similar to the closure 33 seen in FIGS. 3 and 4 so that the difference lies in the provision in the FIG. 6 embodiment of an apertured orifice plate 67 for the disposition of redundant primers 66 such that the full thrust of the rocket motor carried in the outlet opening 74 of the head cap is applied to perform the operation for which it is designed. The presence of the orifice plate 67 and the primers 66 acts to prevent flow of the hot gases in the same direction as the thrust of the rocket motor. In FIG. 2 once the explosive train has performed its function the housing is open between its inlet and outlet ends. The embodiment of FIG. 6 has provided redundant primers, and eliminated the expense of providing a piston and a firing pin element along with a shear pin for activating a single primer, and greatly reduces the expense and increases the reliability of the device.

In obtaining the objectives heretofore pointed out, the preferred form of the invention resides in the improvement of a housing having inlet and outlet ends and an intervening housing cavity in communication with those ends, an explosive train mounted in the housing cavity and suitably protected against environ mental exposure, and means for directing hot ballistic gas directly at the explosive train to initiate its function such that the environmental protection provisions for the explosive train do not lessen the ability to obtain the firing of the explosive train so as to secure the end result desired.

The invention illustrated in FIGS. 2 thru 4 and 6 inclusive is considered to set forth the presently preferred embodiment of the invention so as to accomplish the advantages of simplicity of construction, the reduction of cost of manufacturing and a greatly increased reliability in its function. However, it will be appreciated by those skilled in the art that there are possible changes and modifications that may come to mind without departing from the true spirit and scope of the invention.

What is claimed is:

1. In a hot ballistic gas fired device, the improvement comprising:

(a) a housing having opposite spaced inlet and outlet ends and an intervening cavity between said inlet and outlet ends, said cavity being defined by an internal shoulder facing said inlet end;

(b) holder means in said housing cavity, said holder means having a surface thereon for abutment against said internal shoulder of said cavity;

(c) explosive train means carried by said holder means in operative position in said housing;

(d) seal means on said holder means, said seal means being positioned to face said housing inlet end and also being spaced from said explosive train means to provide a second cavity; and (e) hot ballistic gas delivery means for said housing, said delivery means having an end in abutment with said holder means adjacent said seal means and having a passage therethrough for delivering hot ballistic gas directly against said seal means for causing rupture of said seal means and activation of said explosive train.

2. The improvement set forth in claim 1 wherein said seal means is a frangible member having minimum resistance to the hot ballistic gas delivered against said seal means.

3. The improvement set forth in claim 1 wherein said seal means is surficially scored to form lines of weakness which are fractured by the ballistic pressure effect of the hot ballistic gas delivered against said seal means.

4. The improvement set forth in claim 3 wherein a coating of a sealant is applied over said surficial score lines for assuring the closing of the same to exclude environmental effects.

5. The improvement set forth in claim 4 wherein said seal means is aligned with said passage in said delivery means and said seal means upon being fractured is received in said second cavity.

6. In a hot ballistic gas fired device for use in an emergency escape system of an aircraft having a source of hot gas ballistically released into the system, the improvement in the escape system comprising:

(a) an elongated housing having an axial bore extending from an inlet end to an outlet end, said axial bore being formed with an internal shoulder and a counterbore extending toward said outlet end, said internal shoulder and counterbore defining a cavity therein with an inlet end leading to said cavity from said axial bore and an outlet leading to said axial bore outlet end and defined by a second shoulder at one end of said cavity;

(b) holder means adapted to bit into said housing cavity and formed with an external shoulder for abutment against said internal shoulder, said holder having an internal space defined in part by a second cavity at one end and an opposite outlet;

(c) an explosive means mounted in said internal space of said holder means between said second cavity and said second shoulder; and (d) seal means enclosing said explosive means on said housing, said seal means protecting said explosive means from environmental influences, and being fastened to said holder adjacent said second cavity and said outlet, and said seal means adjacent said second cavity being rupturable into said second cavity under the effect of hot ballistic gas delivered to said housing inlet.

7. In a hot ballistic gas fired device, the improvement which comprises:

(a) a housing having an inlet end for reception of the ballistic gas and an outlet end, and an internal bore in said housing in communication with both said inlet and outlet ends; said internal bore having a portion of its length formed with threads and an adjacent portion providing a housing cavity;

(b) holder means threadedly located in said threaded portion of said internal bore in said housing in advance of said housing cavity, said holder means providing a first cavity facing said housing inlet end and a second cavity facing said housing outlet end;

(c) an explosive train mounted by said holder means between said first and second cavities;

(d) plate means having orifices therethrough and primer means disposed in said housing bore between said holder and said housing outlet end, said orifice plate being abutted by said holder means and orifices in said orifice plate means being open to said second cavity adjacent said explosive train; and (e) environmental protective closure means carried by said holder means over said first cavity in position for rupture by the housing reception of ballistic gas at said inlet end, said closure means rupture forming petals driven into said first cavity.

8. The improvement set forth in claim 7 wherein said protective closure presented toward said housing inlet end is initially weakened to present a minimum resistance to the hot ballistic gas delivered against it.

9. The improvement set forth in claim 7 wherein said protective closure is weakened by scoring, and a coating covers said scoring to preserve the environmental protection.

10. The improvement set forth in claim 7 wherein said explosive train includes at least one primer and an igniter cartridge adjacent said primer to be activated by said primer, said primer being presented to said explosive train which is responsive to the delivery of hot ballistic gas, said igniter cartridge being presented to said housing outlet end.

* * * * *

UNITED STATES PATENT AND TRADEMARK OFFICE

CERTIFICATE OF CORRECTION

PATENT NO. : 4,612,857

DATED : September 23, 1986

INVENTOR(S) : Morry L. Schimmel

It is certified that error appears in the above-identified patent and that said Letters Patent is hereby corrected as shown below:

Column 2, line 35, cancel "ah" and substitute therefor "an".

Column 3, line 62, cancel "torn" and substitute therefor "turn".

Column 3, line 62, cancel "1552" and substitute therefor "52".

Column 4, line 54, cancel "environ mental" and substitute therefor "environmental".

Column 5, line 52, after "outlet" and before "leading" insert "opening".

Signed and Sealed this

Ninth Day of December, 1986

*Attest:*

DONALD J. QUIGG

*Attesting Officer*

*Commissioner of Patents and Trademarks*